US011725472B2

(12) United States Patent
Urban et al.

(10) Patent No.: US 11,725,472 B2
(45) Date of Patent: Aug. 15, 2023

(54) OPEN TIP DOWNHOLE EXPANSION TOOL

(71) Applicants: Larry Urban, Santa Fe, TX (US); Gary Anderson, Dublin, OH (US); Tyler Shirk, Houston, TX (US); Tanner Welch, Houston, TX (US)

(72) Inventors: Larry Urban, Santa Fe, TX (US); Gary Anderson, Dublin, OH (US); Tyler Shirk, Houston, TX (US); Tanner Welch, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/132,734

(22) Filed: Dec. 23, 2020

(65) Prior Publication Data

US 2022/0195829 A1 Jun. 23, 2022

(51) Int. Cl.
*E21B 33/12* (2006.01)

(52) U.S. Cl.
CPC ..... *E21B 33/1208* (2013.01)

(58) Field of Classification Search
CPC .. E21B 33/1212; E21B 33/1208; F16J 15/166
See application file for complete search history.

(56) References Cited

U.S. PATENT DOCUMENTS 49,783 A 9/1865 Parham, Jr.
3,346,267 A 10/1967 Farley
4,162,079 A 7/1979 Jelinek
6,896,049 B2 5/2005 Moyes
8,151,894 B2 * 4/2012 Nutley ..... E21B 33/10 166/207
9,228,411 B2 1/2016 Themig
(Continued)

FOREIGN PATENT DOCUMENTS

EP 1408195 B1 4/2004
WO 2019051468 A1 3/2019

OTHER PUBLICATIONS

Yablon, Dalia, Confusion of moduli, Nov. 16, 2017, Wiley Analytical Science, Available from: https://analyticalscience.wiley.com/do/10.1002/micro.2417/full/ (Year: 2017).*
(Continued)

*Primary Examiner* — Theodore N Yao
(74) *Attorney, Agent, or Firm* — Cantor Colburn LLP

(57) ABSTRACT

An open tip downhole expansion tool incudes a frustoconical member having a base and a tip, the member having a radially outer zone and a radially inner zone and having an axial length extending from the base to the tip; an outer compliance area in a material of the member along a length of the radially outer zone; and an inner compliance area in a material of the member along a length of the radially inner zone, the outer and inner compliance areas being located at different positions along the axial length of the frustoconical member, the outer and inner compliance areas each causing the frustoconical member to present a first resistance to deformation when the compliance areas are in a first condition and a higher resistance to deformation of the frustoconical member when the compliance areas are in a second condition.

9 Claims, 5 Drawing Sheets

(56) References Cited

U.S. PATENT DOCUMENTS

| | | | | |
|---|---|---|---|---|
| 9,359,860 | B2 | 6/2016 | Hallundbaek et al. | |
| 9,732,581 | B2 | 8/2017 | Morehead | |
| 9,784,066 | B1 | 10/2017 | Branton et al. | |
| 10,443,343 | B2 | 10/2019 | Doane et al. | |
| 2005/0023003 | A1 | 2/2005 | Echols et al. | |
| 2006/0219415 | A1* | 10/2006 | Xu | E21B 33/1216 166/387 |
| 2008/0296845 | A1 | 12/2008 | Doane et al. | |
| 2009/0277648 | A1* | 11/2009 | Nutley | E21B 33/10 166/208 |
| 2010/0186970 | A1 | 7/2010 | Burnett et al. | |
| 2010/0263857 | A1 | 10/2010 | Frazier | |
| 2012/0055667 | A1* | 3/2012 | Ingram | E21B 33/1216 166/119 |
| 2012/0217025 | A1 | 8/2012 | Shkurti et al. | |
| 2013/0147121 | A1 | 6/2013 | Xu | |
| 2014/0290946 | A1* | 10/2014 | Nguyen | E21B 43/10 166/179 |
| 2014/0319783 | A1* | 10/2014 | Gomez | E21B 33/1216 277/649 |
| 2016/0097252 | A1 | 4/2016 | Resink | |
| 2018/0172160 | A1 | 6/2018 | Urban et al. | |
| 2019/0040710 | A1 | 2/2019 | Deng et al. | |
| 2019/0249511 | A1* | 8/2019 | Deng | E21B 23/06 |
| 2019/0368304 | A1 | 12/2019 | Deng et al. | |

OTHER PUBLICATIONS

Notification of Transmittal of the International Search Report and the Written Opinion of the International Searching Authority, or the Declaration; PCT/US2021-073010; dated Apr. 1, 2022: 10 pages.

Notification of Transmittal of the International Search Report and the Written Opinion of the International Searching Authority, or the Declaration; PCT/US2021/073011; dated Apr. 15, 2022: 10 pages.

* cited by examiner

OPEN TIP DOWNHOLE EXPANSION TOOL

BACKGROUND

In the resource recovery industry there is often reason to expand diametrically a tool. This may be to support a tubular or span an annulus, for example. One common tool that is frequently used will be characterized herein as an open tip downhole expansion tool. While there are a number of tools that fit within this characterization, one of them is a backup for an element of a seal. Such tools are deflected from a run in position to a deployed position based upon pressure in the element from inflation or compression thereof, for example. There are competing interests with respect to such tools. These are ease of setting and durability of holding once set. The simplest recitation of this is a thinner material tool will set easily but also fail easily and a thicker material tool will be difficult to set but will likely not fail once set. It is important to the art to manage these competing interests.

In view of the above, the art will benefit from a new configuration for an open tip downhole expansion tool.

SUMMARY

An embodiment of an open tip downhole expansion tool including a frustoconical member having a base at a diametrically smaller portion of the frustoconical member and a tip at a diametrically larger portion of the frustoconical member, the member having a radially outer zone and a radially inner zone and having an axial length extending from the base to the tip; an outer compliance area in a material of the member along a length of the radially outer zone; and an inner compliance area in a material of the member along a length of the radially inner zone, the outer and inner compliance areas being located at different positions along the axial length of the frustoconical member, the outer and inner compliance areas each causing the frustoconical member to present a first resistance to deformation when the compliance areas are in a first condition and a higher resistance to deformation of the frustoconical member when the compliance areas are in a second condition.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

The terms "about", "substantially" and "generally" are intended to include the degree of error associated with measurement of the particular quantity based upon the equipment available at the time of filing the application. For example, "about" and/or "substantially" and/or "generally" include a range of ±8% or 5%, or 2% of a given value.

Figure 1:
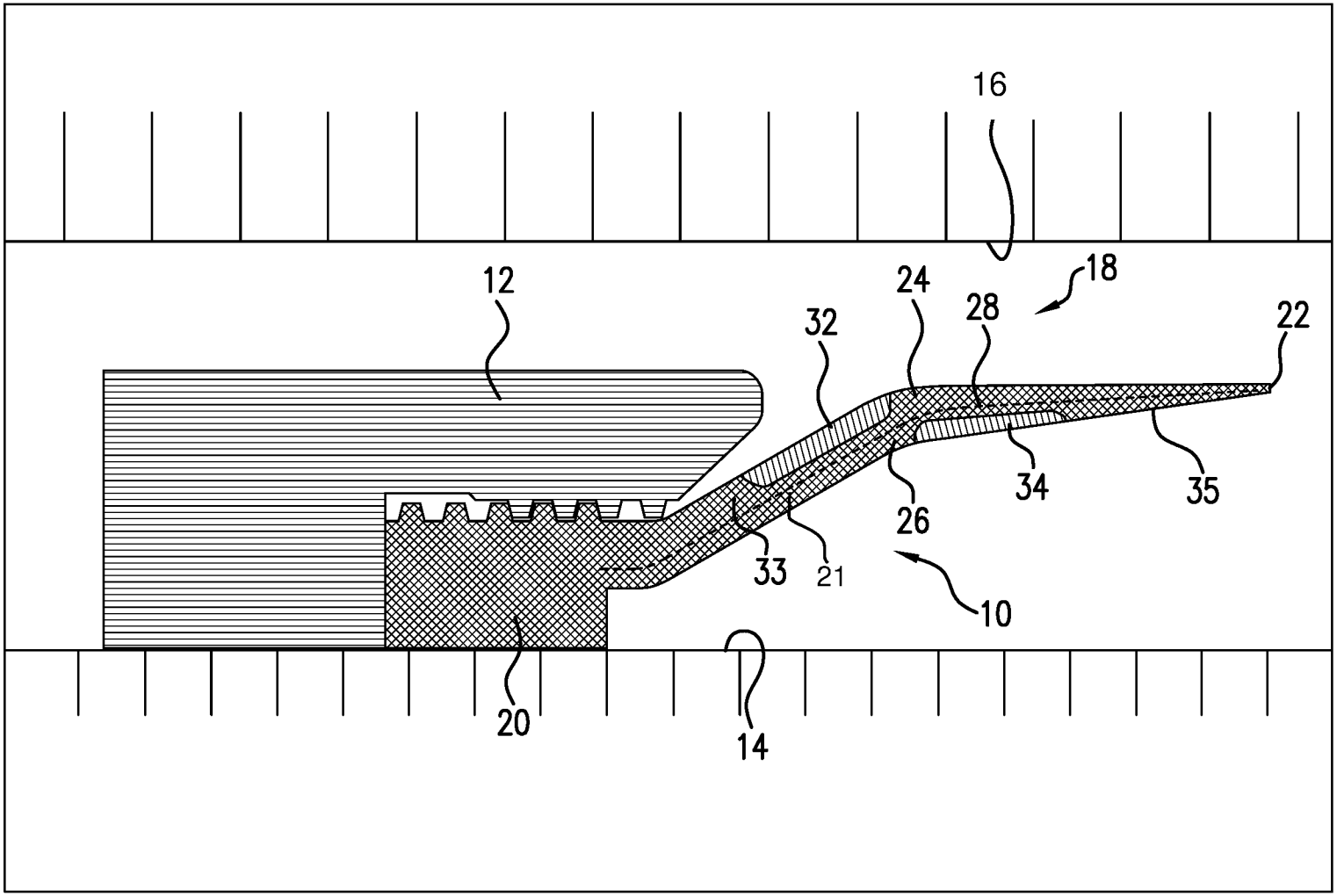
FIG. 1 is a schematic sectional view of an open tip downhole expansion tool as disclosed herein.

Referring to FIG. 1 an open tip downhole expansion tool 10 is illustrated adjacent a gauge ring 12 on a mandrel 14 and within a tubular 16 in which the tool 10 is to be set. The tool 10 as disclosed comprises a body 18 whose structure demands only a relatively low pressure to set and yet provides a high resistance to failure through plastic deformation. The body 18 includes a base portion 20, a frustoconical portion 21 and an open tip portion 22 wherein the base portion 20 presents a diametrically smaller structure than the tip portion 22. body 18 further features a radially outer zone 24 and a radially inner zone 26 that are delineated for illustrative purposes by a dashed line 28 along the frustoconical portion 21 and tip portion 22 of body 18. It is to be understood that although, in FIG. 1, the dashed line 28 roughly partitions the body 18 to be ½ outer zone 24 and ½ inner zone 26, it is contemplated that the radially inner zone 26 may be smaller or larger or the radially outer zone 24 may be smaller or larger including the inner or outer zone being ¼ of the thickness of the material of the body 18 and the other of the radially inner or radially outer zone being ¾ of the thickness of the material of the body 18, for example. Further, the radially inner and radially outer zones need not together represent the entirety of the material thickness of the body 18. Rather, in embodiments, there may also be one or more other zones through the thickness of the material; the radially inner and radially outer zone merely forming a portion of the whole. The body 18 also presents an axial length 30 extending from the base to the base portion 20 to the tip portion 22.

An outer compliance area 32 is created in the material of the body along a length of the radially outer zone 24. The compliance area 32 may be in the form of a reduced material modulus. In one example such reduced modulus may be achieved by causing area 32 to have a reduced density. Density as a material property may be adjusted for the compliance area 32 such that the density of the material of the radially outer zone 24 in area 32 is less than the density of adjacent material of the radially outer zone 24. The material itself may be the same or a different material. Whether the material of the radially outer zone 24 is all the same and simply possesses a reduced density at the area 32 or is actually a distinct material at the area 32 having reduced density, or alternatively some other property that promotes deflection for a certain distance and then retards deflection beyond that distance, the purposes of the body 18 are achieved. The area 32 will compress more easily than surrounding areas until the density of the material in area 32 is raised by compressive forces thereon. After the material in area 32 is compressed, its strength and resistance to deflection increase. Reduced material modulus is easily achieved, for example, in an additive manufacturing process wherein same or different materials may be grown with same or different modulus. The art is well versed in how to achieve the material property differences employed in connection with the inventive structure as described herein. The depth of the compliance area 32, width of the compliance area 32, as well as the number of compliance areas 32 are adjustable parameters.

In FIG. 1, compliance area 32 is illustrated. It is to be appreciated that in the embodiment of FIG. 1, the compliance area 32 extends from the outside surface 33 of the body 18 and into (and in some cases through) the radially outer zone 24 of the body 18. In an embodiment, the compliance area 32 is positioned to be where the body 18 will make contact with the gauge ring 12 or some other structure in the various embodiments. It is further to be appreciated, however, that other embodiments do not employ a gauge ring or similar at all but rather the compliance area 32 maximizes flexibility of the body 18 when setting. During the setting process, the compliance area 32 will start in a first condition where deflection is easier and become denser or work hardened, or experience some other material change that exhibits greater resistance to deflection or bending resistance in a second condition. The increase in bending resistance is valuable for containing higher element pressures that may be experienced after the setting process.

Similar to the compliance area 32, an inner compliance area 34 is also disclosed. The inner compliance area is placed in the material of the body 18 along a length of the radially inner zone 26. The compliance area 34 may be similar in form to that of compliance area 32 and extending into the material of the body 18 from a surface 35 of the body 18 or a chamber within the material of the body 18. The depth of the compliance area 34, width of the compliance area 34, as well as the number of compliance areas 34 are adjustable parameters. Depth of the compliance area 34 is related to overall body compliance with greater depth being proportional to greater compliance. In FIG. 1, the compliance area 34 is illustrated. It is to be appreciated that in the embodiment of FIG. 1, the compliance area 34 extends from the inside surface 35 of the body 18 and into (and in some cases through) the radially inner zone 26 of the body 18. The compliance area 34 is positioned as illustrated to be where the body 18 will need to bend in a direction to accommodate the tip 22 contacting an inside dimension of a tubular in which the tool is set. In some embodiments where a sealing element is employed, this maximizes flexibility of the body 18 about the element when setting. During the setting process, the compliance area 34 will become denser or work hardened, or experience some other material change that exhibits greater resistance to deflection or bending resistance. The increase in bending resistance is valuable for containing higher element pressures that may be experienced after the setting process.

Figure 4:
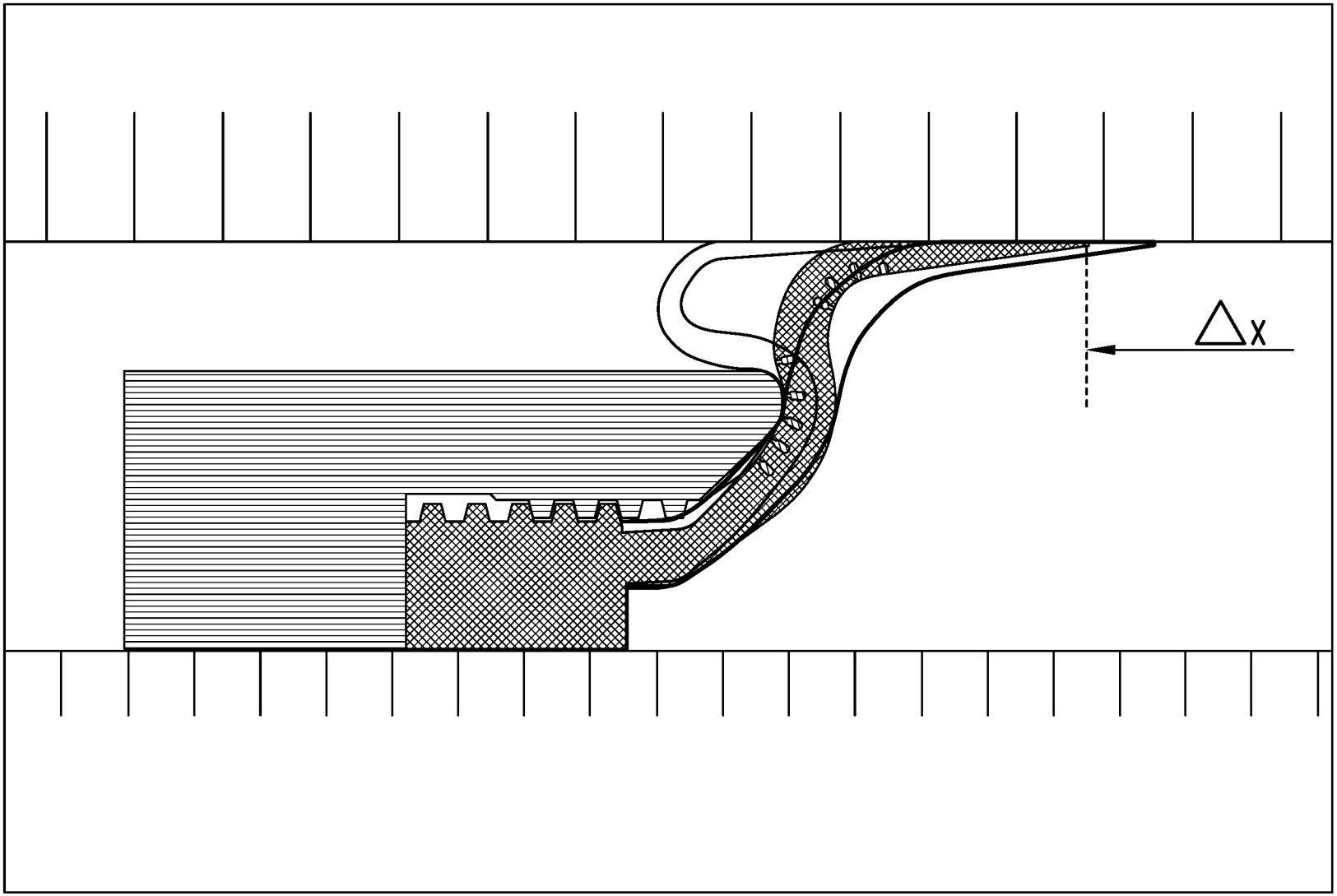
FIG. 4 is a schematic view of all three above tools overlays and in a set position.

Referring to FIG. 4, each of a prior art open tip downhole expansion tool, a thicker open tip downhole expansion tool and the inventive open tip downhole expansion tool are overlayed to indicate the relative positions they would take during a setting process and at the same pressures. As one will appreciate, the inventive open tip downhole expansion tool is in a near perfect position while the prior art open tip downhole expansion tool is overly deformed and ready to fail and the thick open tip downhole expansion tool has failed to be fully properly set. The prior art open tip downhole expansion tool will be inadequate for higher after setting pressures and the thick open tip downhole expansion tool will require excessive setting pressures. The inventive open tip downhole expansion tool maximizes usablility and reliability.

Figure 2:
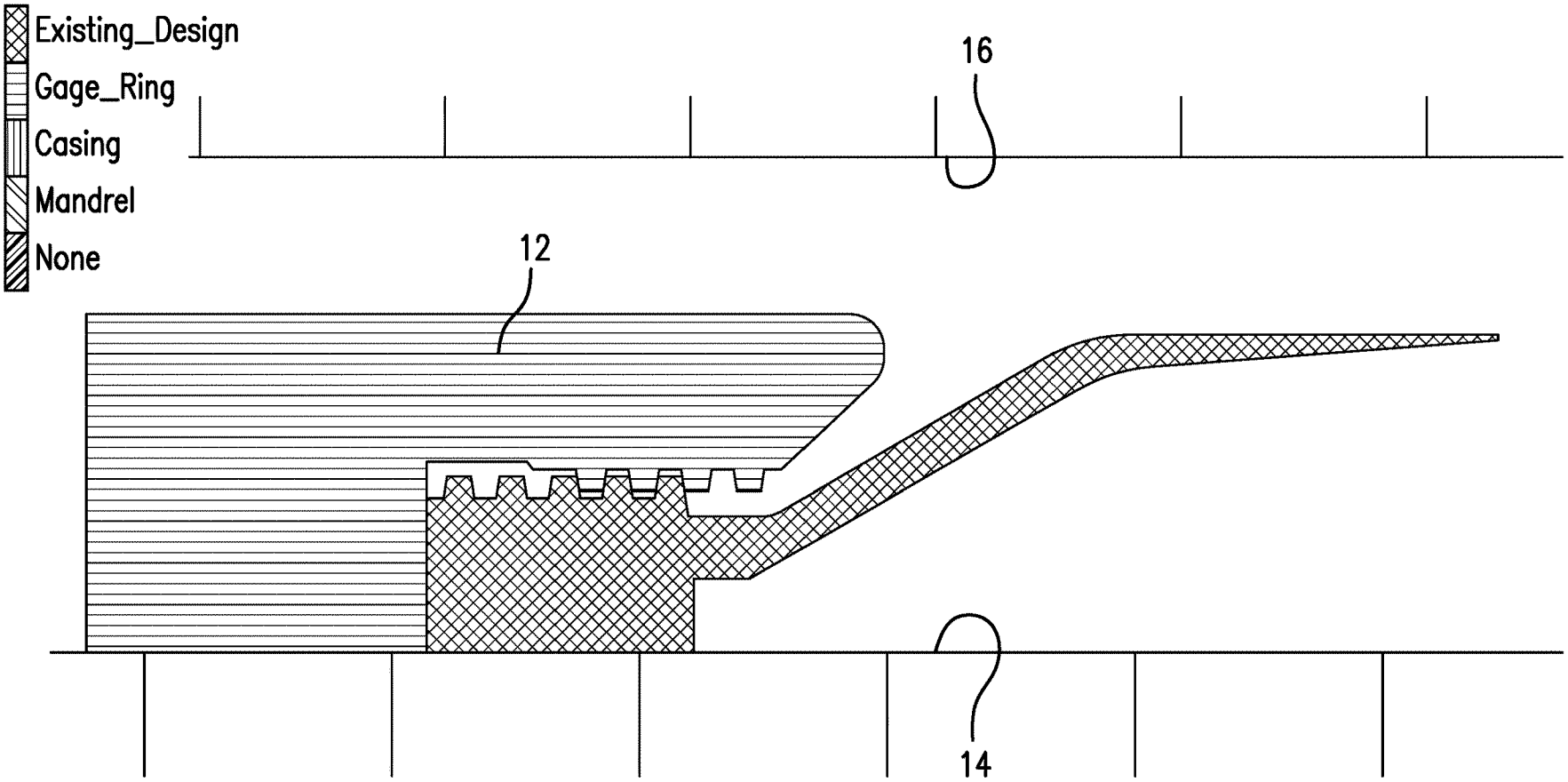
FIG. 2 (Prior Art)
FIG. 2 is a schematic sectional view of an open tip downhole expansion tool that is relatively common in the art (prior art)
Figure 3:
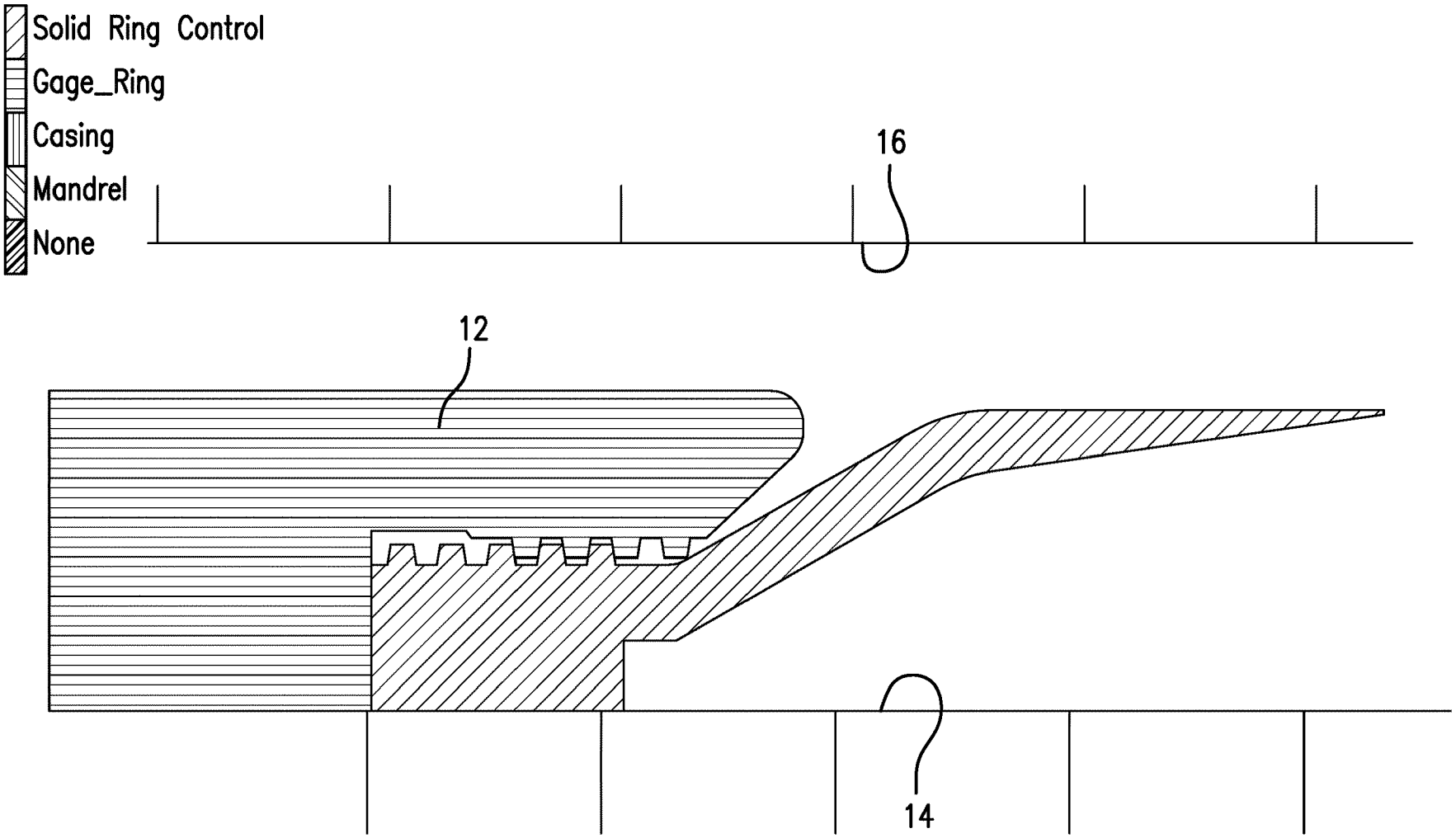
FIG. 3 is a schematic sectional view of an open tip downhole expansion tool of greater thickness than would be used in the art but presented for comparison with characteristics of the tool disclosed herein.
Figure 5:
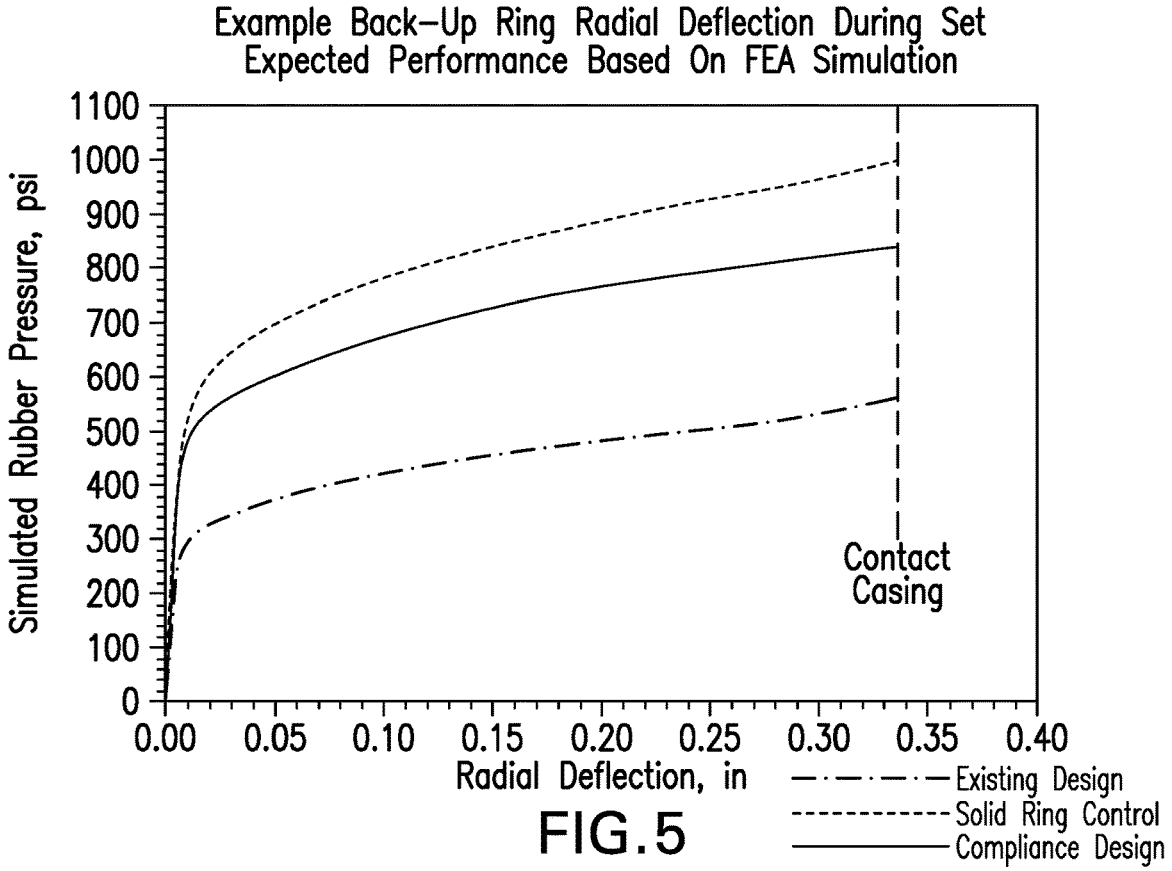
FIG. 5 is a graph of rubber pressure versus radial deflection of each of the open tip downhole expansion tools of FIGS. 1-3 used in a capacity as a seal element backup ring.
Figure 6:
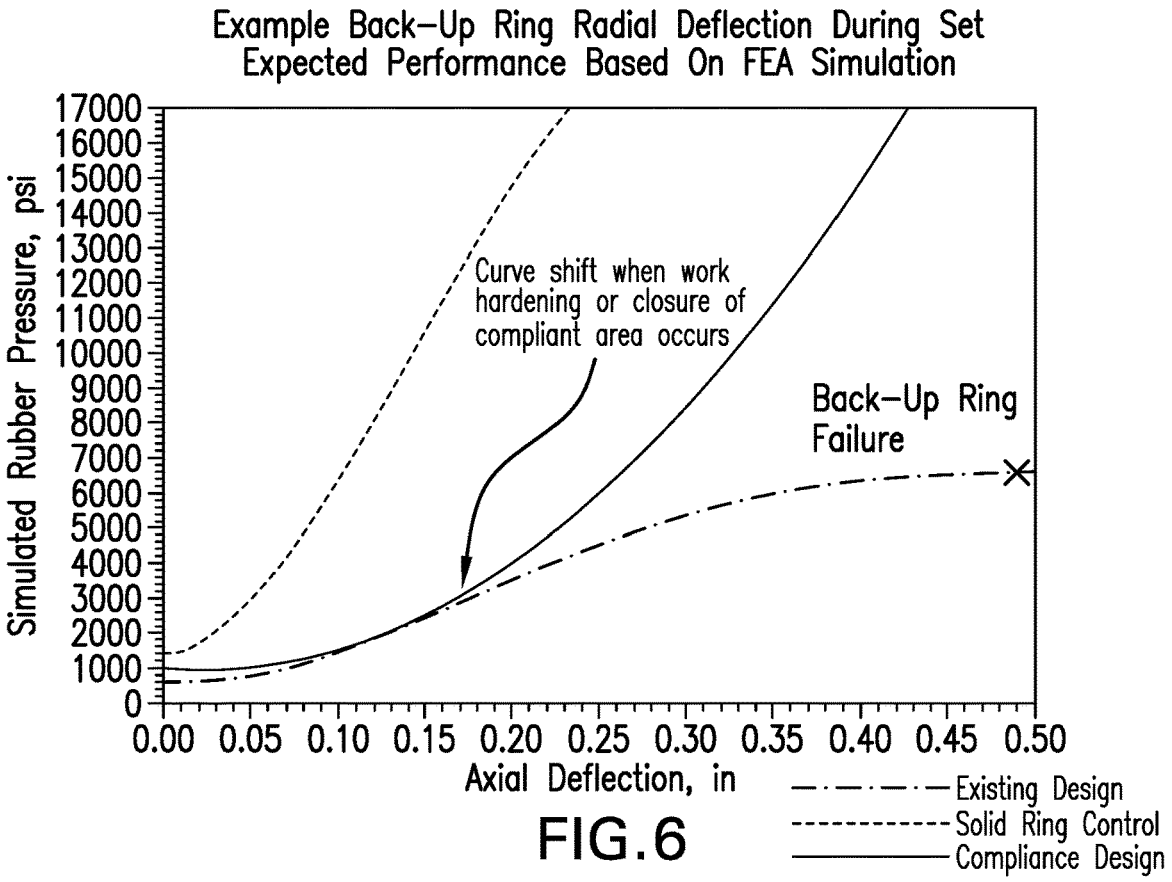
FIG. 6 is a graph plotting rubber pressure versus axial deflection of each of the open tip downhole expansion tools of FIGS. 1-3 used in a capacity as a seal element backup ring after casing contact has occurred.

With regard to the above assertion that resistance to deformation increases dramatically with compliance areas changing their bending resistance, the graphs identified as FIGS. 5 and 6 convey rubber pressure versus radial deflection of each of the open tip downhole expansion tools of FIGS. 1-3 used in a capacity as a seal element backup ring and rubber pressure versus axial deflection of each of the open tip downhole expansion tools of FIGS. 1-3 used in a capacity as a seal element backup ring after casing contact has occurred, respectively. It is readily apparent from these graphs that the inventive open tip downhole expansion tool performs significantly better than the others depicted. Similar benefits are reaped by using the inventive open tip downhole expansion tool for duties other than as a seal element backup ring. Considering FIG. 6, the graph makes the superior properties of the disclosed tool evident.

Set forth below are some embodiments of the foregoing disclosure:

Embodiment 1: An open tip downhole expansion tool including a frustoconical member having a base at a diametrically smaller portion of the frustoconical member and a tip at a diametrically larger portion of the frustoconical member, the member having a radially outer zone and a radially inner zone and having an axial length extending from the base to the tip; an outer compliance area in a material of the member along a length of the radially outer zone; and an inner compliance area in a material of the member along a length of the radially inner zone, the outer and inner compliance areas being located at different positions along the axial length of the frustoconical member, the outer and inner compliance areas each causing the frustoconical member to present a first resistance to deformation when the compliance areas are in a first condition and a higher resistance to deformation of the frustoconical member when the compliance areas are in a second condition.

Embodiment 2: The tool as in any prior embodiment, wherein at least one of the radially inner zone and radially outer zone is about ½ a radial thickness of a material of the frustoconical member.

Embodiment 3: The tool as in any prior embodiment, wherein one of the radially inner zone and radially outer zone is about ¼ of a radial thickness of a material of the frustoconical member.

Embodiment 4: The tool as in any prior embodiment, wherein at least one of the outer compliance area and the inner compliance area is of reduced modulus.

Embodiment 5: The tool as in any prior embodiment, wherein the reduced modulus is a function of material density.

Embodiment 6: The tool as in any prior embodiment, wherein the is a compliance area extends from an outer or inner radial surface respectively of the frustoconical member to a depth of between about ¼ and about ¾ of a radial thickness of a material of the frustoconical member.

Embodiment 7: The tool as in any prior embodiment, wherein the modulus of the compliance area changes during the setting of the tool.

Embodiment 8: The tool as in any prior embodiment, wherein at least one of the inner compliance area and the outer compliance area is a plurality of compliance areas.

Embodiment 9: The tool as in any prior embodiment, wherein the plurality of compliance areas each extend from a surface of the member into the material of the member The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An open tip downhole expansion tool comprising:

a single layer body including a frustoconical portion, the body having a base portion at a diametrically smaller part of the body and a tip portion at a diametrically larger part of the body, the body having a radially outer zone defined by being toward an outer surface of the body from a midline of a wall thickness of the body and a radially inner zone defined by being toward an inner surface of the body from the midline and having an axial length extending from the base portion to the tip portion;

an outer compliance area in a material of the body along a length of the radially outer zone; and an inner compliance area in the material of the body along a length of the radially inner zone, the outer and inner compliance areas being located at different positions along the axial length of the body, the outer and inner compliance areas each causing the body to present a first resistance to deformation when the compliance areas are in a first condition and a higher resistance to deformation of the body when the compliance areas are in a set condition.

2. The tool as claimed in claim 1 wherein at least one of the radially inner zone and radially outer zone is within 8 percent of ½ a radial thickness of the material of the frustoconical portion and tip portion.

3. The tool as claimed in claim 1 wherein one of the radially inner zone and radially outer zone is within 8 percent of ¼ of a radial thickness of the material of the frustoconical portion and tip portion.

4. The tool as claimed in claim 3 wherein the outer compliance area or inner compliance area extends from an outer or inner radial surface, respectively, of the frustoconical portion and tip portion to a depth of between within 8 percent of ¼ and within 8 percent of ¾ of a radial thickness of the material of the frustoconical portion and tip portion.

5. The tool as claimed in claim 1 wherein at least one of the outer compliance area and the inner compliance area is easier to deform than surrounding areas of the body.

6. The tool as claimed in claim 5 wherein the at least one of the outer compliance area and the inner compliance area is a reduced material density relative to surrounding areas of the body.

7. The tool as claimed in claim 1 wherein at least one of the inner compliance area and the outer compliance area is a plurality of compliance areas.

8. The tool as claimed in claim 7 wherein the plurality of compliance areas each extend from a surface of the frustoconical portion and tip portion into the material of the frustoconical portion and tip portion.

9. The tool as claimed in claim 1 wherein the single layer of the body is continuous.

* * * * *